US006267424B1

(12) United States Patent
Gillette

(10) Patent No.: US 6,267,424 B1
(45) Date of Patent: Jul. 31, 2001

(54) COMPACT GRAPPLING HOOK PARTICULARLY ADAPTED FOR MILITARY/TACTICAL ENTRY/EXIT OPERATIONS IN URBAN TERRAIN

(76) Inventor: William A. Gillette, 2050 Dotsonville Rd., Clarksville, TN (US) 37042

( * ) Notice: Subject to any disclaimer, the term of this patent is extended or adjusted under 35 U.S.C. 154(b) by 0 days.

(21) Appl. No.: 09/366,716

(22) Filed: Aug. 4, 1999

Related U.S. Application Data

(60) Provisional application No. 60/095,271, filed on Aug. 4, 1998.

(51) Int. Cl.[7] ..... B66C 1/34

(52) U.S. Cl. ..... 294/82.1; 294/66.1; 294/97

(58) Field of Search ..... 294/66.1, 82.1, 294/82.3–82.34, 86.24, 86.25, 86.4, 95, 97, 106, 115, 116; 114/294, 298, 301–310

(56) References Cited

U.S. PATENT DOCUMENTS

| | | | | |
|---|---|---|---|---|
| 1,295,076 | * | 2/1919 | Sherman et al. | 294/66.1 X |
| 2,887,980 | * | 5/1959 | Madden | 114/305 X |
| 3,021,812 | * | 2/1962 | Swails | 114/298 |
| 3,651,777 | * | 3/1972 | Ehrlichmann | 114/305 |
| 3,766,878 | * | 10/1973 | Hogue | 114/304 X |
| 4,133,569 | * | 1/1979 | Pavack et al. | 294/66.1 X |
| 4,379,580 | * | 4/1983 | Staempfli | 294/66.1 X |
| 4,702,507 | * | 10/1987 | Medendorp | 294/66.1 |

FOREIGN PATENT DOCUMENTS

| | | | | |
|---|---|---|---|---|
| 151053 | * | 9/1920 | (GB) | 294/66.1 |
| 409995 | * | 3/1945 | (IT) | 114/307 |

* cited by examiner

*Primary Examiner*—Johnny D. Cherry
(74) *Attorney, Agent, or Firm*—McDermott, Will & Emery

(57) ABSTRACT

A light weight compact grappling hook which finds use in at least urban terrain comprising a small head member provided with a plurality of arms or blades which are serrated and/or provided with cutting surfaces/edges. The shaft which is connected to the head can be rigid or flexible. The flexible feature facilitates achieving a hold on surfaces which might otherwise be difficult. The arms or blades are each pivotally supported on pairs of pins and can be spread from folded storage positions and locked in position prior to deployment, or can be spring biased so that spreading and operative deployment is achieved en route to the target.

27 Claims, 20 Drawing Sheets

COMPACT GRAPPLING HOOK PARTICULARLY ADAPTED FOR MILITARY/TACTICAL ENTRY/EXIT OPERATIONS IN URBAN TERRAIN

CROSS-REFERENCE TO RELATED APPLICATIONS

This application claims priority from Provisional Patent Application Ser. No. 60/095,271 filed on Aug. 4, 1998, entitled COMPACT GRAPPLING HOOK PARTICULARLY ADAPTED FOR MILITARY/TACTICAL TYPE ENTRY/EXIT OPERATIONS IN URBAN TERRAIN. The content of this Provisional Patent Application is hereby incorporated by reference thereto.

BACKGROUND OF THE INVENTION

1. Field of the Invention

The present invention relates generally to grappling hooks. More specifically, this invention relates to a grappling hook arrangement which is light, robust and which can be folded into a compact arrangement that can be readily transported to and from a site at which entry/exit use is desired.

2. Description of the Related Art

Under specialized conditions such as encountered in tactical operations such as Mounted Operations in Urban Terrain (MOUT), for example, the ability to be able to hurl a grappling hook up onto a roof or a high structure such as a building, tower or the like, is essential. However, currently available grappling hooks are heavy and cumbersome, and the entering/exiting of a site, such as a high building, can deteriorate into a debacle if there is a need to make multiple throws before a good hold is achieved. As will be appreciated, the above type of tactical operations require speed and stealth and the time needed to make a number of throws and to tolerate the noise produced by a throw which misses and clatters to the ground, can spell the difference between success and failure.

The ability to store the devices in a backpack or the like and to be able to carry this type of equipment to the site of use is also vital. Accordingly, the weight of a grappling hook must be small and the device highly compact to permit a person to carry it along with other equipment such as considerable lengths of rope, etc. However, the distribution of the weight is also important to ensure a good flight path after being propelled into the air.

A clear need for a lightweight, compact piece of equipment which can be hand thrown or fired from a launching device, therefore exists, especially under the above types of conditions. This need has not been satisfied by currently commercially available units.

SUMMARY OF THE INVENTION

The present invention is, in light of the above, directed to providing a light weight grappling hook which is suited for entry/exit of sites such as buildings, fences, towers and the like.

The present invention is further directed to providing a light weight grappling hook which can be folded into a compact arrangement suitable for easy transport to and from the site of use.

In addition to the above, the present invention is directed to providing a light weight grappling hook which can be fired from a device such as a grenade launcher, and which remains folded into its compact form until such time as it is in flight toward a target.

Still further, the present invention is directed to providing a light weight grappling hook which has blades which can be pivotally deployed from a folded state and which are shaped and/or serrated in a manner which provides maximum grip on surfaces such as concrete/steel and the like from which buildings are often made.

The present invention is also directed to providing a light weight grappling hook which has multiple applications and which can be fired or manually thrown to a target area and/or used to breach trip wires, antipersonnel and tilt-rod type anti-tank mines.

Additionally, the present invention is directed to providing a light weight grappling hook which has a flexible shaft and which facilitates getting good engagement even when the device does not have a 90° bite and which tends to eliminate the need to make second or third throws to obtain proper placement of the device.

In brief, in order to achieve the above objects a small head member is provided with a plurality of arms or blades which are serrated and/or provided with cutting surfaces/edges. A shaft which is connected to the head can be either rigid or flexible. In the case that the shaft is flexible, achieving a hold on surfaces which might otherwise be difficult, is facilitated. The arms or blades themselves are each pivotally supported on pairs of pins and can be spread from folded storage positions and locked in position prior to deployment, or can be spring biased so that spreading is achieved en route to the target.

More specifically, a first aspect of the invention resides in a grappling hook comprising: a head member; first and second pins; an arm pivotally mounted on the first pin, said arm being formed with a curved slot in which the second pin slides; and a shaft operatively connected with said head member.

The invention is further designed such that the head member is formed with a slot and wherein the arm has an end portion received in the slot, and wherein the head member has a manually operable locking device which allows the arm to be selectively locked in a predetermined position.

The invention further features biasing means for biasing the arm to pivot from a position wherein it is essentially parallel with the shaft, to a position wherein it is essentially perpendicular to the shaft. Another feature is that the shaft can be flexible and includes a connector at a lower end for connection with a rope or strap.

In instances where the invention is to be launched from a powered device, the arm can be provided with a hook member which is adapted to clip onto the mouth of a barrel of the launching device.

Another feature of the invention resides in the provision of an elastomeric sleeve which fits over a barrel of a device which launches the grappling hook toward a selected target. This sleeve has a toroidally shaped recess which extends about the barrel and which receives an end of the arm that is distal from the first and second pins and which retains the arm in a position wherein it is essentially parallel with the shaft until such time as the grappling hook is launched from the barrel.

In order to improve the grip and engagement on surfaces such as encountered in urban terrain, for example, the arm is provided with a plurality of serrations along a lower edge portion thereof. To complement this, the arm is provided with a first sharp cutting edge along an upper edge portion thereof to enable in-flight cutting of objects which are encountered along the way. In addition to the above, a second sharp cutting edge formed at a free end edge of the arm is provided, the first and second sharp cutting edges forming two sharp points which dig into surfaces engaged thereby.

A second aspect of the invention resides in a grappling hook comprising: a head member having a plurality of arm receiving slots; a plurality of arms respectively received in the plurality of slots, each of the arms having a round hole and a curved slot formed therein; a plurality of first and second pins, each of the first pins being disposed through a round hole formed in each of the arms, and each of the second pins being received in a curved slot formed in each of the arms, each of the slots being so dimensioned that when the arms assume a first folded position, each of the second pins is located at or proximate a first end of the respective slots, and when the arms are swung out from the first folded position to a second unfolded position, the second pins are located at or proximate a second end of the respective slots; and a shaft operatively connected with the head member, the shaft being rigid and flexible.

This second aspect, of course, also features locking means for locking the arms in their respective second unfolded positions. This locking means can also include a locking aperture formed in each of the arms.

BRIEF DESCRIPTION OF THE DRAWINGS

The various features and attendant advantages of the present invention will become more apparent as a description of the preferred embodiments is given with reference to the appended drawings in which:

FIG. 25 is a side view of a variant of a blade which can be used with the embodiments of the invention and which has an angled portion which improves the grip on hard surfaces such as concrete and the like;

DETAILED DESCRIPTION OF THE PREFERRED EMBODIMENTS

Figure 1:
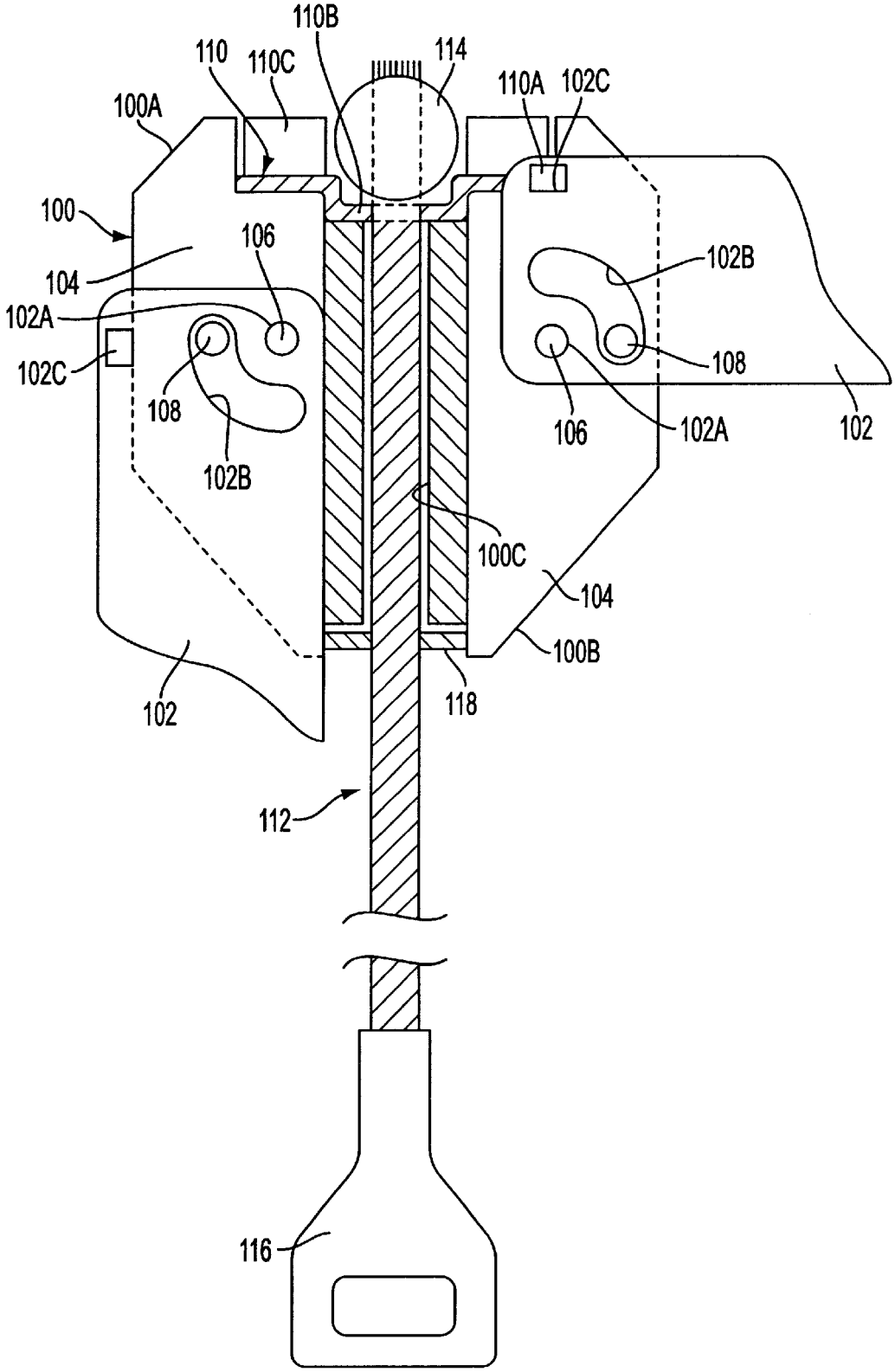
FIG. 1 is a partially sectioned view showing a grappling hook according to a first embodiment of the invention.
Figure 2:
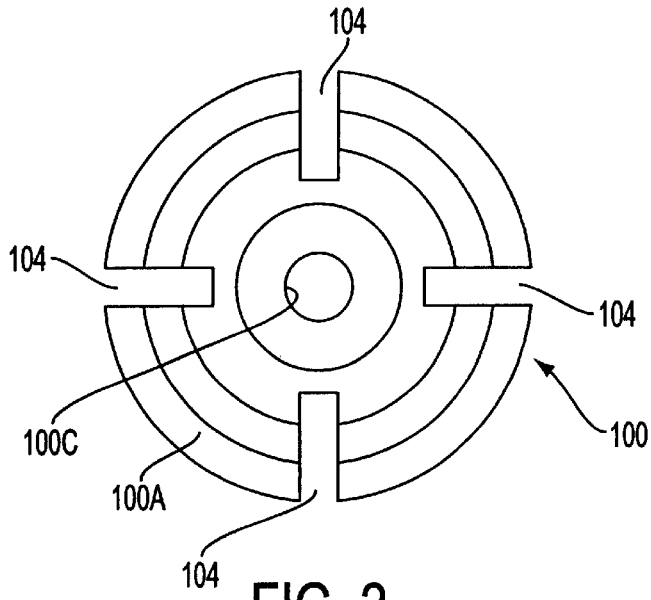
FIG. 2 is a plan view showing the top of a head member which forms a vital part of the first embodiment.

FIG. 1 shows a first embodiment of the present invention. In this arrangement, a body or head 100 is provided with a plurality of pivotal blade-like pawls or arms 102. The head 100 is formed with four slots 104 in the manner depicted in FIG. 2. Each of these slots 104 receives the inboard end of the arms 102. The head 100 is, in this instance, made from cylindrical stock and has upper and lower tapers or chamfers 100A, 100B, turned thereon. A through bore 100C is formed coaxially through the head 100. The upper end of the bore has two countersunk portions reamed therein while the lower end is provided with only one.

Each of the arms 102 is provided with a drill hole 102A through which a first pin 106 is disposed and about which the arm 102 is pivotal. Each arm is further formed with an arcuate slot 102B which is adapted to slidably receive a second pin 108. In this embodiment, in addition to the two pin receiving apertures, each arm 102 is additionally provided with a locking aperture 102C. These locking apertures 102C are adapted to receive the locking pawls 110A of a locking member 110 of the nature shown in FIG. 3, and which has a dished center portion 110B which is adapted to seat in the second of the countersinks formed in the top of the head 100. This locking member 110 is provided with upstanding tab members 110C which are adapted to facilitate the manual manipulation of the locking member 110 between locked and un-locked positions.

As depicted on the right hand side of FIG. 1, when the arms are each pivoted from a storage position to an operative one, and the locking member 110 is rotated clockwise, each locking pawl 110A engages in a locking aperture, thus preventing pivotal movement of the arms 102 back toward their storage positions.

A shaft member 112, which in this embodiment is formed of steel cable (wire rope) which is encased in a plastic sheath, has a ball member 114 swaged at its upper portion and a swaged steel ring or the like 116 at the lower portion. As shown, when this shaft member 112 is disposed through the bore 100C, the ball 114 can seat in a dished portion 110B of the locking member 110. By disposing one or more C rings 118 about the cable and forcing these into the recess defined by the countersink at the lower end of the through bore 100C, and simultaneously pulling the shaft member 112 back through the through bore 100C, the ball 114 is retained in its position in the dished portion 110B of the locking member 110 and thus secures the locking member 110 in position.

The flexible cable which forms the shaft member 112 is, in accordance with the invention, of great utility, in that it permits the shaft to flex in a manner which permits the arms to bite in and take hold under conditions wherein, if the shaft were to be rigid, the arms 102 might be lifted out of engagement. More specifically, in the instance the grappling hook is used on a roof, for example, the traction which is applied to a rigid shaft might produce a moment which would lever the arms up and away from a position wherein good engagement was achieved, and thus force the need for repeated attempts to achieve a good hold. In other words, the flexibility of the shaft 112 permits it to curve over sharp right angle corners and the like and to apply tractive force about corners.

As will be appreciated, the first embodiment is simple and rugged. The provision of two pins 106, 108, per arm increases reliability and, once in the lock position, the arms are effectively connected to the head member at three points, viz., the two pins and a locking pawl.

By way of example, the head 100 can be made of either chromalloy, steel, titanium or aluminum stock, which is milled/turned, and fitted with arms which are of the same material as the head. The length of the arms 102 is about 4.5 inches providing an overall span of about 10 inches when the hook is open. The overall length of the device when folded is between 9 and 12 inches and preferably has a weight of 1.5–3.0 lbs., and is sufficiently compact to be stored in a soldiers butt pack, for example.

In application, the hook can be inverted to allow gravity to move the arms 102 from their stored position to a full open condition, and the locking device 110 is manipulated to lock the arms 102 open. The device is then ready to hurl toward an intended target.

Figure 3:
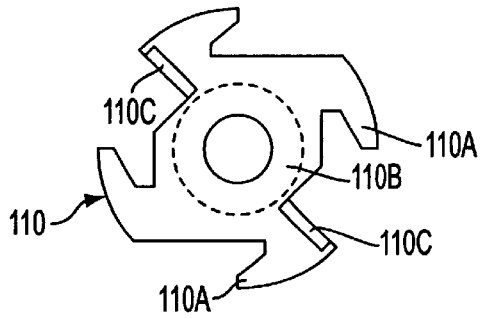
FIG. 3 is a plan view of a locking device which can be used to lock the pivotal pawls or grappling arms (blades) of the first embodiment in an operative position.
Figure 4:
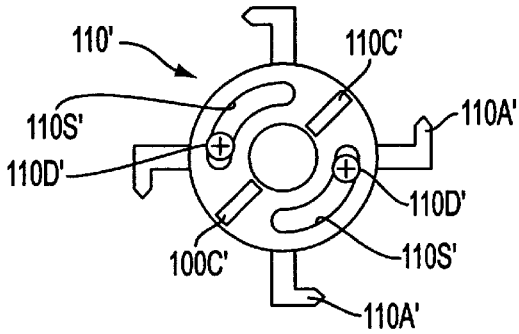
FIG. 4 is a plan view of a variation of a locking device which can be used with the first embodiment of the invention.

FIG. 4 shows an variant of the locking device shown in FIG. 3 and is 30 accordingly denoted by the numeral 110'. In addition to pawls 110A' and upstanding tabs 110C', this device is provided with a pair of arcuate slots 110S' which are adapted to have screws disposed therethrough. By boring and tapping two holes in suitable positions in the upper surface of the head 100, it is possible to tighten the screws and set the resistance to rotation to a level suitable for ensuring that the movement from either of the locked or unlocked positions is resisted with a suitable amount of friction.

The present invention is not limited to climbing and can be used for tasks such as breaching trip wires, tripping anti-personnel mines and tilt-rod type anti-tank mines, for example. In this connection, as well as the climbing aspects of the invention, the arms which are used with the present invention can be provided with sharp cutting edges as well as points/serrations. The device can be fired through jungle to cut a path therethrough. Pulling the device back using a line or cable, facilitates further cutting and/or tripping of anti-personnel devices.

Figure 7:
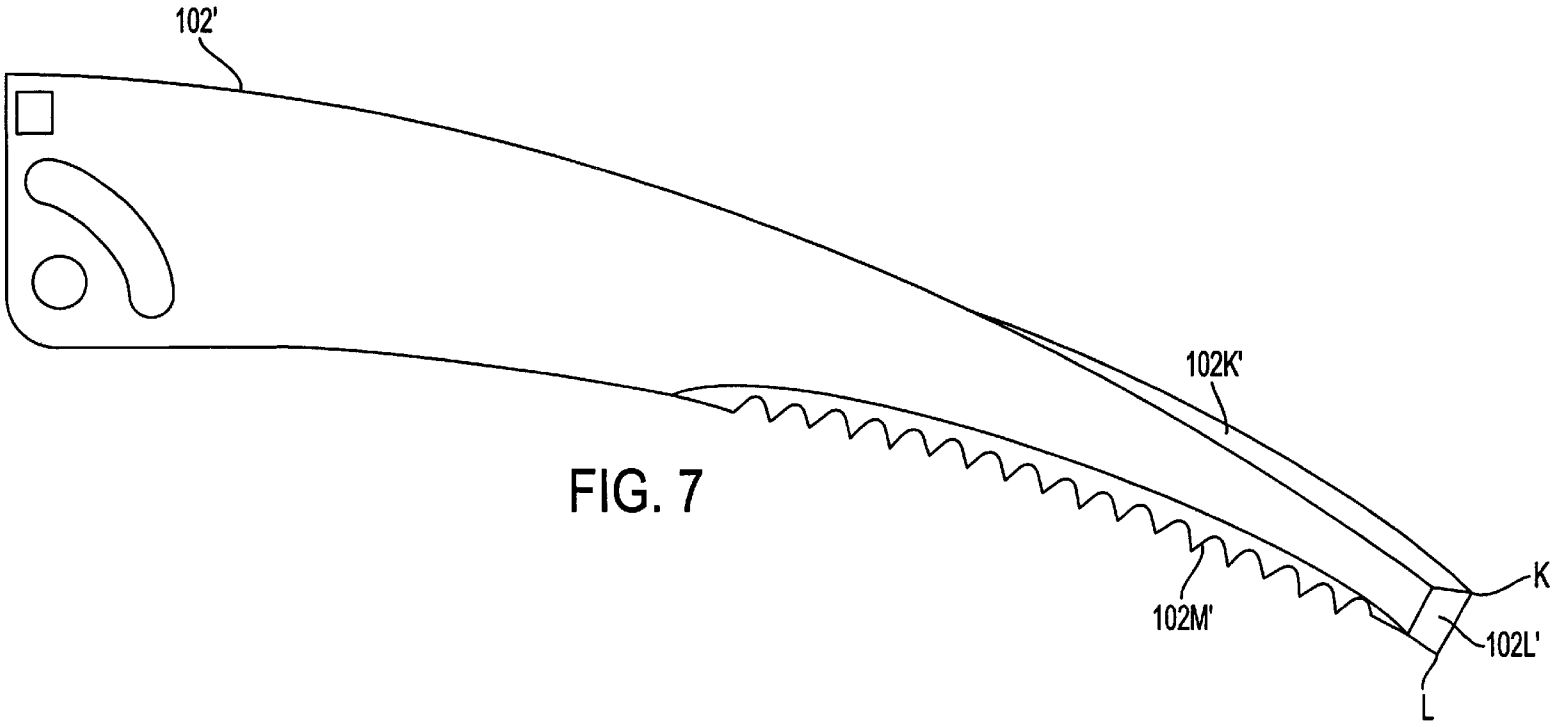
FIGS. 7 and 8 are respectively side elevation and plan views of an arm which can be used in connection with the first embodiment of the invention.
Figure 8:
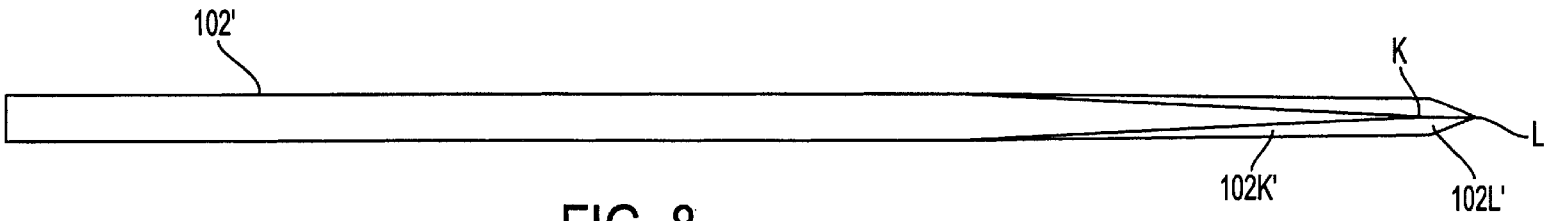

FIGS. 7 and 8 show an example of an arm design which can be advantageously used with the present invention. As will be essentially self-evident, the arm 102' has tapered edges 102K', 102L' formed along the upper and tip edge portions which cooperate to form two sharp corners K and L. The underside is formed with sawtooth-like serrations 102M' which cut into and hold on relatively smooth surfaces such as are apt to be encountered in urban terrain.

Figure 9:
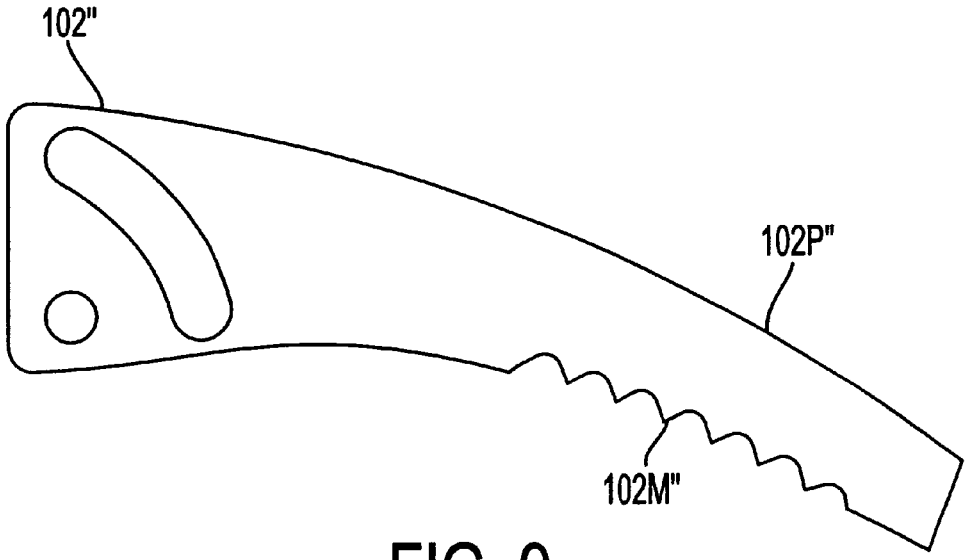
FIGS. 9, 10 and 11 are respectively side elevation, plan and end elevations of an arm which can be used in connection with the embodiments of the invention.
Figure 10:
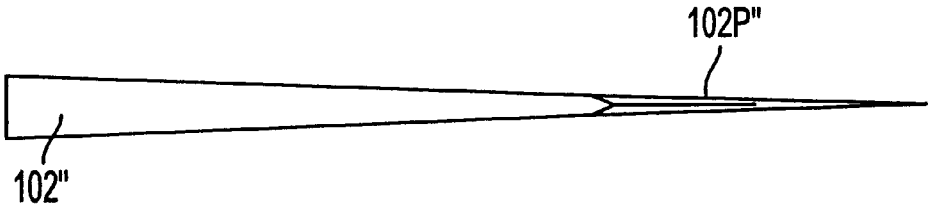
Figure 11:
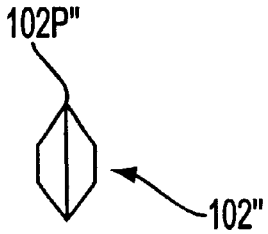

FIGS. 9 to 11 show another example of arm configuration which can be used in connection with the embodiments of the invention. As will be appreciated, the illustrated arm is similar to that shown in FIGS. 7 and 8, but has a sharp cutting edge 102P" along the last portion of the upper edge. This edge 102P" can be used to sever wires and the like, for example, which are encountered in the flight of the hook toward its target.

Figure 12:
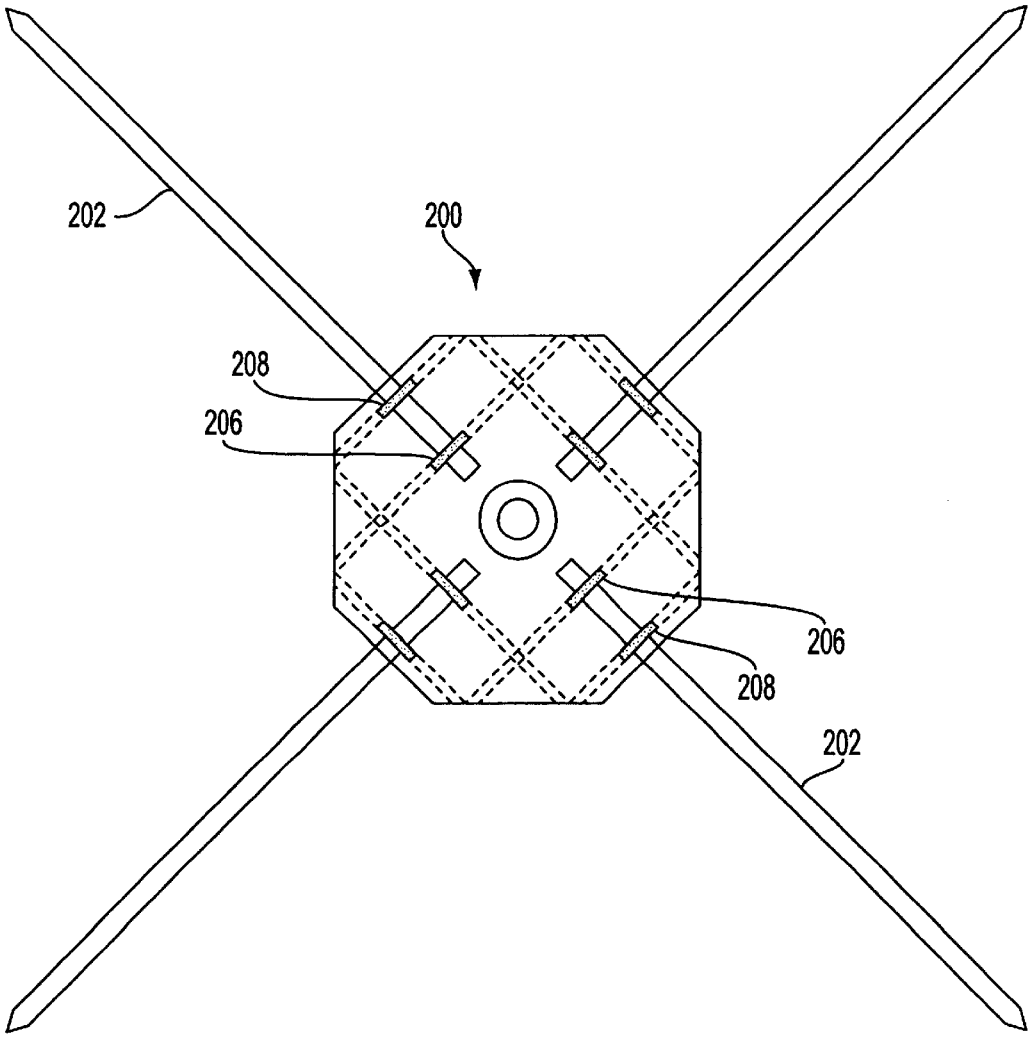
FIG. 12 is a top plan view showing another embodiment of the invention which has been formed of octagonal stock and which depicts the manner in which the bores in which the pins which operatively connect the arms to the main head, are drilled.

FIG. 12 is a plan view of an embodiment of the invention wherein the head 200 is formed from octagonal stock and which demonstrates the manner in which the head is bored to permit the installation of the pins 206, 208 which are used to support the arms 204. In this embodiment, as in all others, the pins 206, 208 are made of a material which is harder and more resistant to shearing than the remainder of the device and which can withstand considerable loads without deformation or loss of integrity.

Figure 13:
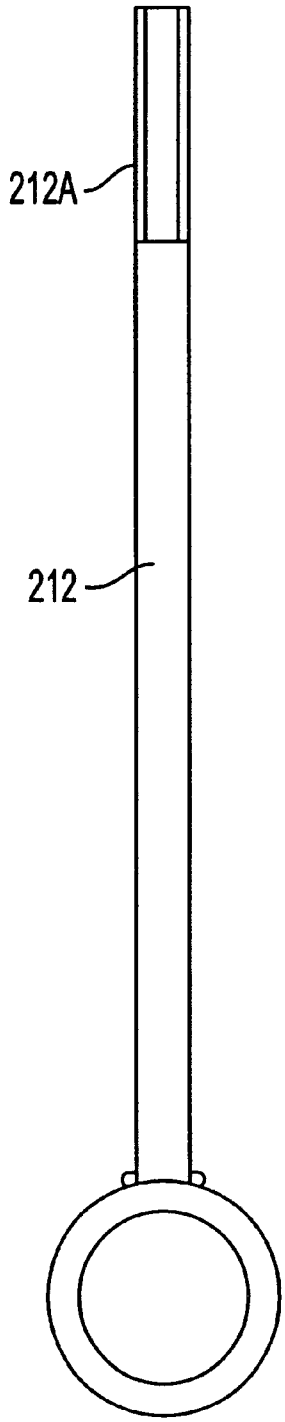
FIG. 13 is a front view of a shaft which can be used in connection with embodiments of the invention and which is provided with a screw thread at its upper end.

FIG. 13 shows a rigid shaft arrangement. The upper end of this shaft 212 is tapped to form a screw thread 212A which can be screwed into a tapped bore formed in the head in the manner shown in FIG. 21, for example, or passed through the head and engaged with a suitable member on the other side.

It is within the scope of the present invention to use arms which do not have locking devices and which are used in combination with biasing arrangements such as springs to bias the blades out toward their respective operative positions. This type of arrangement is of particular use when the hook is used in combination with a powered launching device such as a grenade launcher or the like.

Figure 14:
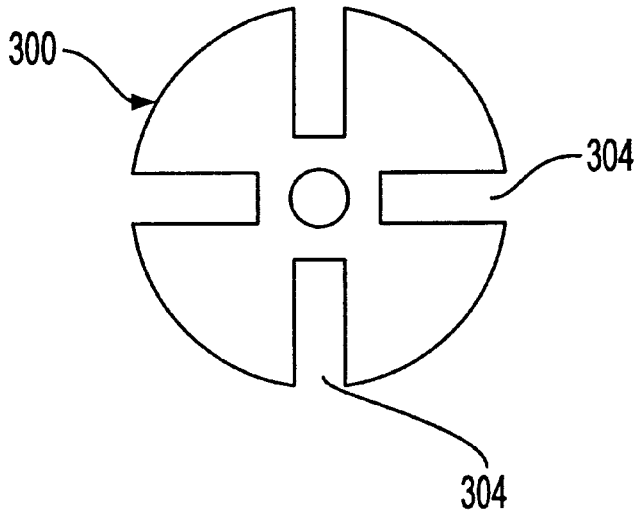
FIG. 14 is a top plan view of a head member of a further embodiment of the invention.
Figure 15:
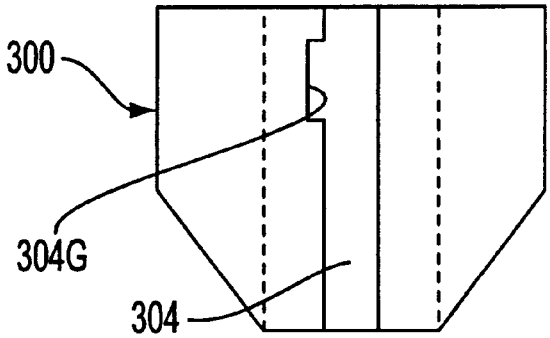
FIG. 15 is a side view of the head member shown in FIG. 14, depicting the provision of a spring receiving slot.
Figure 16:
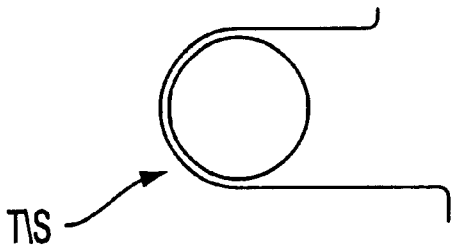
FIG. 16 is a view of a torsion spring which can be disposed in the spring receiving slot shown in FIG. 15, and which can be used to bias the arms of the invention out into operative positions.

FIGS. 14 to 16 show an embodiment wherein the head 300 is provided with grooves 304G in the slots 304 for receiving torsion type springs T/S of the type illustrated in FIG. 16. With this type of arrangement, the springs T/S can be disposed in position and the arms (not shown) slid into the slots and pinned in position.

Figure 17:
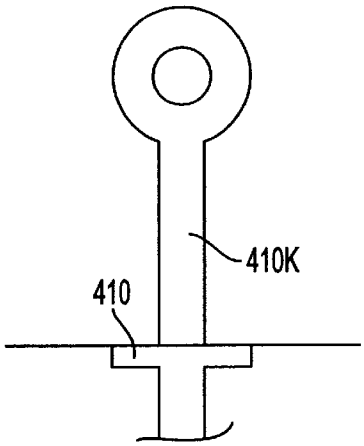
FIG. 17 is a side view of a locking device which can be used with the embodiments of the invention.
Figure 18:
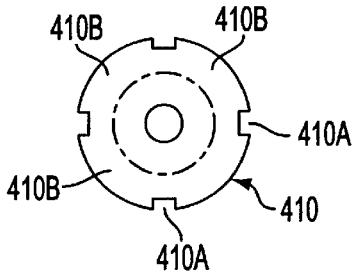
FIG. 18 is a top plan view showing details of the locking device which is used with the key-like member which is shown in FIG. 17.
Figure 19:
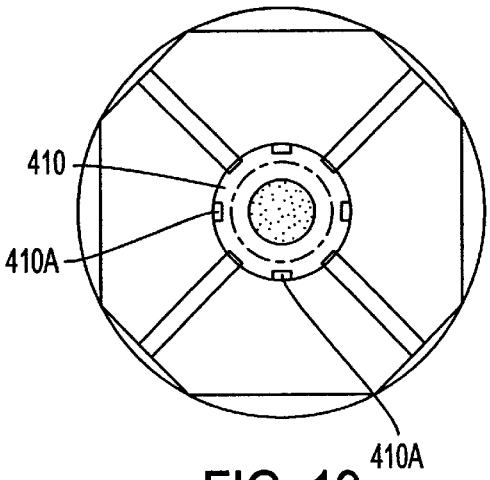
FIG. 19 is a top plan view of an embodiment of the invention which is provided with a locking device of the nature shown in FIGS. 17 and 18.
Figure 20:
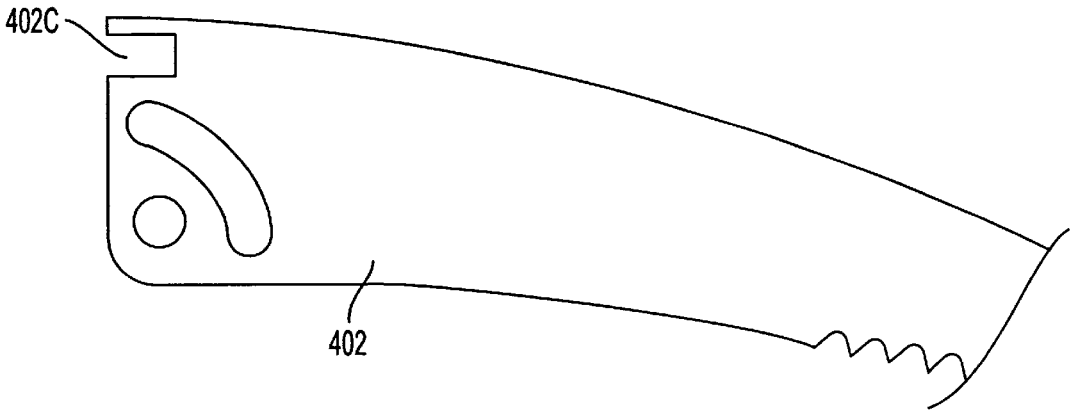
FIG. 20 is a side view of an arm which is adapted for use with the locking device depicted in FIGS. 17–19.

FIGS. 17 to 19 show a variation in locking arrangement. In this instance the locking element takes the form of a disc 410 which is, as best seen in FIG. 18, slotted or recessed at four locations 410A (one for each of the arms), while the arms which cooperate with this type of locking arrangement have, as shown in FIG. 20, an open locking slot 402C. When the arms or blades are deployed, such as by inversion or the use of springs, disc 410 is rotated through the use of key-like arrangement 410K shown in FIG. 17, so that the arcuate sections 41OB of the disc 410 defined between the slots 410A, enter the open locking slots 402C of the arms. Once in this condition, the closing movement of the arms is resisted.

As mentioned above, in some instances, it is advantageous to be able to project the hooks toward their targets using devices such as grenade launchers. However, prior to being fired toward their target, it is preferred to be able to maintain the arms in their folded or storage positions. Further, it is preferable that the arms open up during their flight and switch from inoperative to operative positions.

Figure 21:
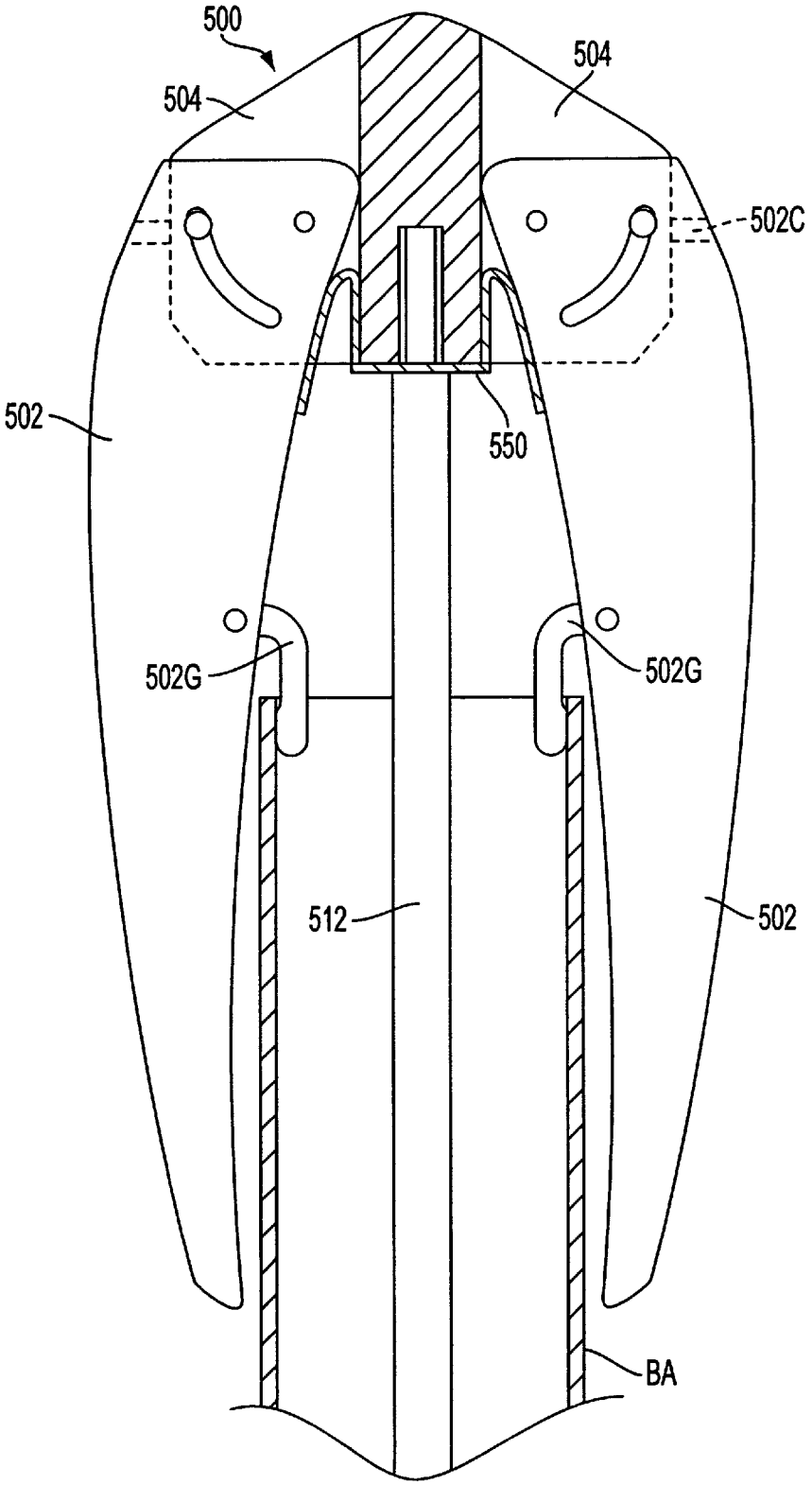
FIG. 21 is a partially sectioned side view of an embodiment which is adapted to be fired from a launching device and which features clip or catch members which engage the inner wall of the barrel of the launcher and which hold the arms of the grappling hook in a folded position.

FIG. 21 shows an embodiment which is adapted to meet these requirements. In this embodiment, the arms 502 are biased out by a flat star-shaped spring arrangement 550, while the arms 502 are provided with hooks or clasp-like holders 502G which grip the inner periphery of a barrel BA of a launching device (not shown) such as an M203 grenade launcher. These hooks 502G can be riveted (welded etc.,) to the arms or can be formed by suitably shaping the blade per se.

As will be appreciated, immediately after being fired into the air, the arms 502 will swing out toward their respective operative positions under the bias of the spring 550 and will remain essentially in these positions even upon reaching the target.

It is worth noting that, in accordance with the present invention, even if one or more of the arms only assume a half-open state, that the function of the grappling hook will be impaired and that the arms or blades can dig into a surface or surfaces in a manner which will adequately bear the required load. The possibility that the arms will pull completely open is also high.

Figure 5:
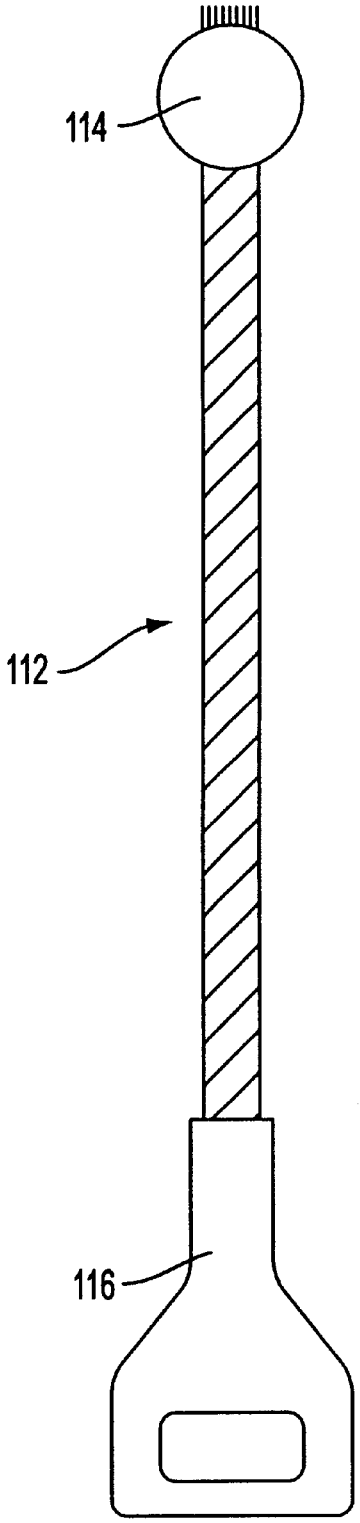
FIG. 5 is a side view of a plastic coated wire cable which forms a flexible shaft which forms an important part of the first embodiment of the invention.
Figure 6:
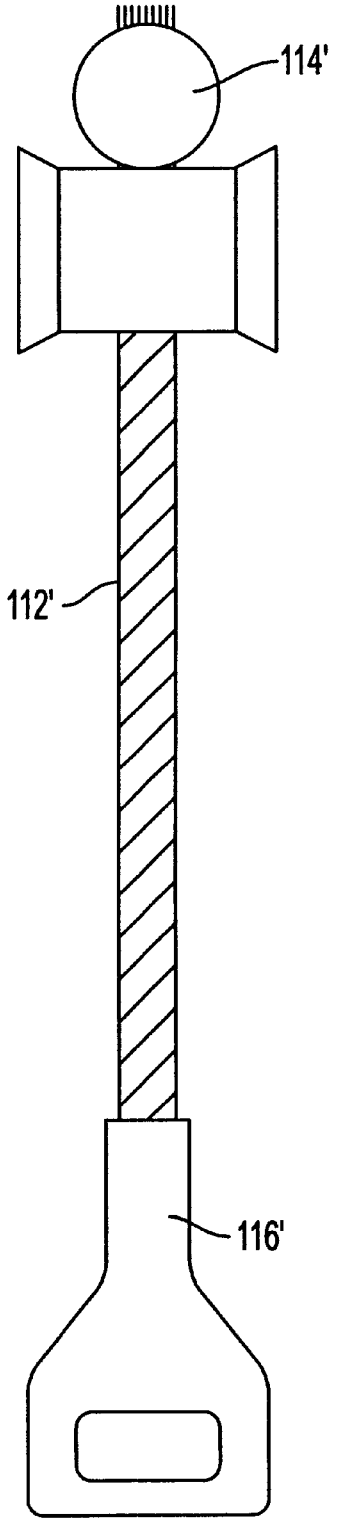
FIG. 6 is a side view showing a variation of the flexible shaft which can be used in connection with the first and/or other embodiments.

The arrangement in FIG. 21 is illustrated as having a rigid shaft 512 which is threaded into the head member 500. While this arrangement does not have a locking arrangement pre se, one could be provided by flattening off the top of the head and retaining locking device such as illustrated in FIG. 3 or 5, in position using a bolt and washer arrangement. In order to facilitate manufacture of the arms, the openings which receive the pawls of the locking device can be simply drilled or cut so as to take the form of a slot 502C which is open at the top edge of the arm in the manner indicated in broken line.

Figure 22:
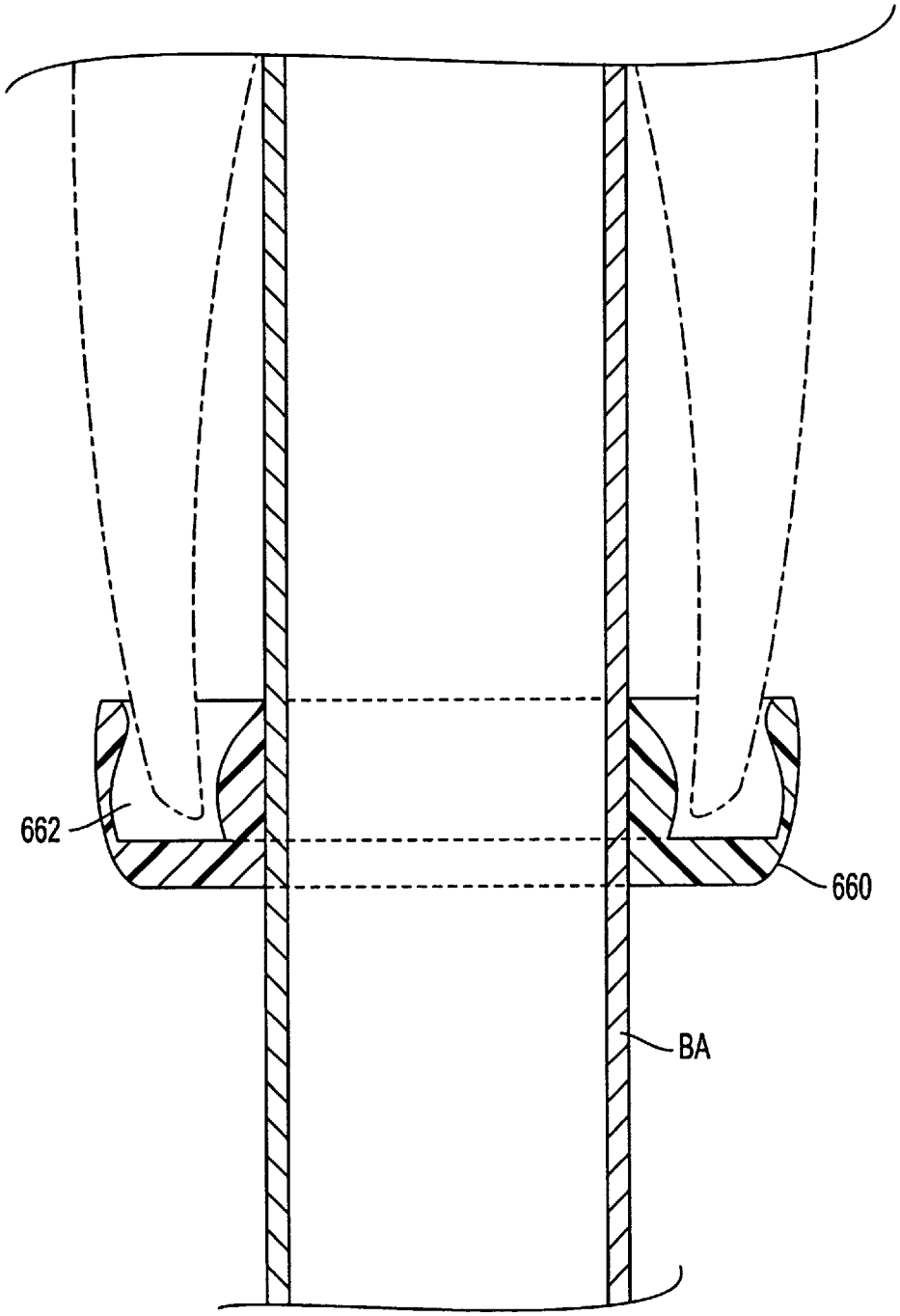
FIG. 22 is a sectional side view showing a barrel of a launcher which can be used in conjunctions with the embodiments of the present invention and which is equipped with an elastomeric member adapted to retain the arms of the grappling hook in a folded position prior to being fired toward a target.

FIG. 22 shows an arrangement which can be used in place of the hooks shown in FIG. 21. In this embodiment, a semi-rigid elastomeric sleeve 660 is slipped over the barrel BA of the launching device and used to temporarily retain the arms of the hook in a folded or stored state. As shown, the tips of the arms (shown in phantom) seat in a recess 662 which extends about the whole sleeve thus defining a shallow toroidal space. It will be noted that for the simplicity of illustration, the shaft and other elements of the grappling hook are omitted.

Figure 23:
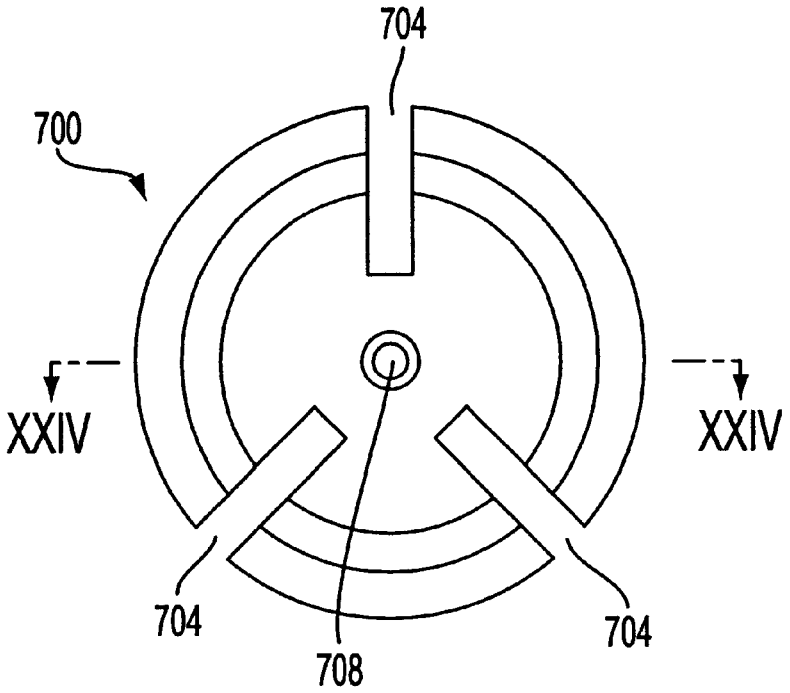
FIG. 23 is a top plan view of a three-bladed embodiment.
Figure 24:
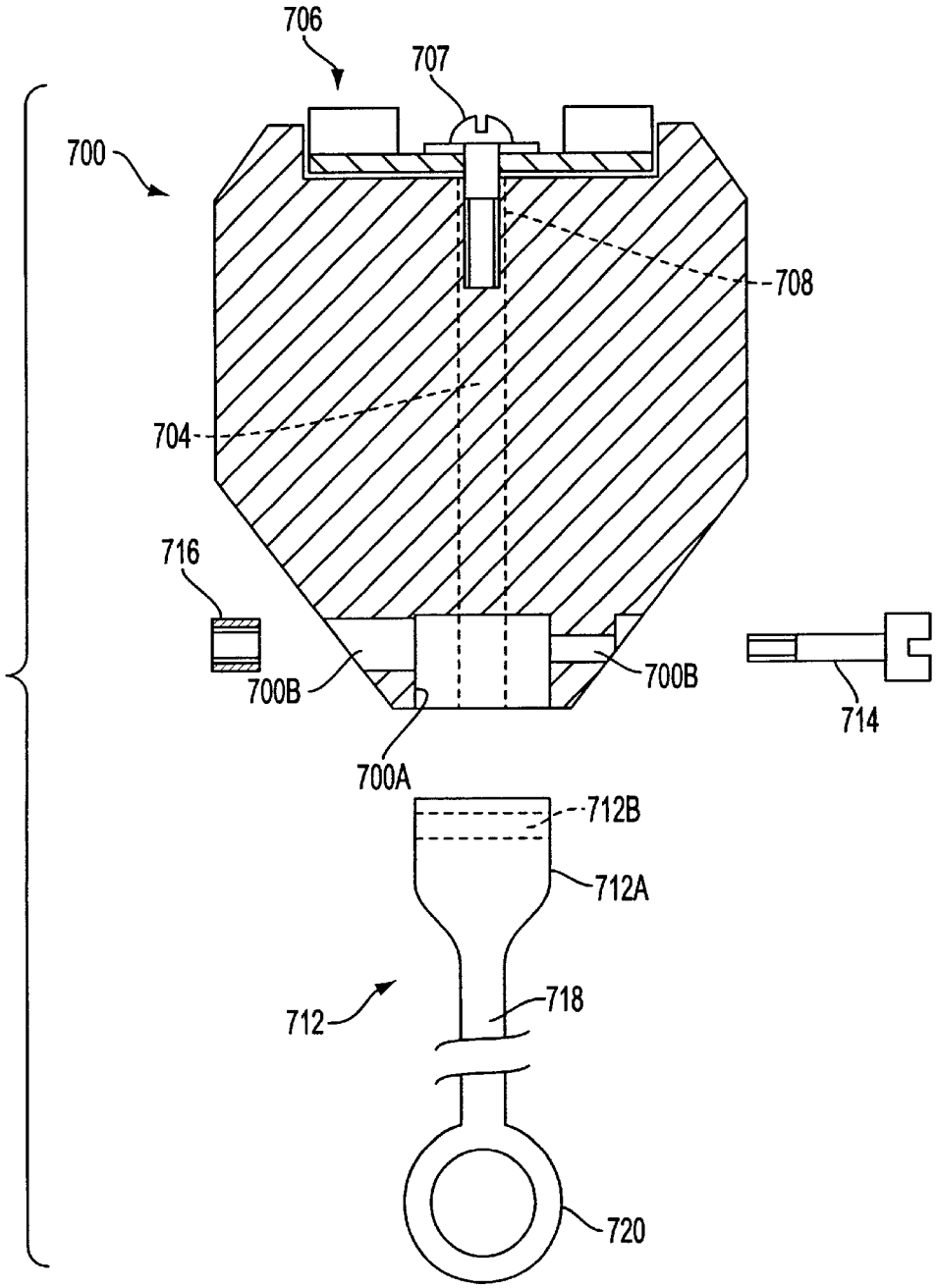
FIG. 24 is an exploded side sectional view showing the constructional details which are used to connect the shaft to the head portion of the device.

FIGS. 23 and 24 show a further embodiment of the invention. This arrangement is adapted to support three blades. As will be appreciated from FIG. 23, the head 700 is formed of round stock and the recesses 704, which are arranged to receive the blades are, in this instance, arranged at equidistant 120° spacings.

FIG. 24 is a sectional view at taken along section line XXIV—XXIV of FIG. 23, and shows details of how the shaft 712 is connected to the head portion of the device. In this embodiment, in order to receive an enlarged upper end portion 712A of the shaft, the head 700 is formed with a blind bore 700A having a diameter very slightly in excess of the OD of the enlarged upper portion 712A. A set of coaxial bores 700B, 712B are formed radially through both the lower end of the head 700 and through an upper end of the upper end portion 712A of the shaft. These bores are sized to receive a bolt 714 and a sleeve nut 716 which, as will be appreciated, is received in a radial bore on one side of the blind bore 700A and arranged to threadedly engage the threaded end of the bolt 714.

This particular type nut and bolt arrangement is suitable in the case wherein the head is formed of aluminum alloy or the like type light metal alloy and forming threads directly in the metal is not practical. However, in the event that the head 700 is formed of a steel or the like, then it is within the scope of the invention to directly tap one end of the radial bore 700B and to use a commercially available bolt.

The locking arrangement 706 which is located at the top of the head can take any of the forms shown in FIGS. 3 and 4, for example, and is secured in place using a screw 707 which is received in a tapped blind bore 708. The shaft 718, in this embodiment, can be solid or can be formed of a braided aircraft cable with the metal end portions (viz., the enlarged upper end 712A and a ring 720) securely mated thereto.

Figure 25:
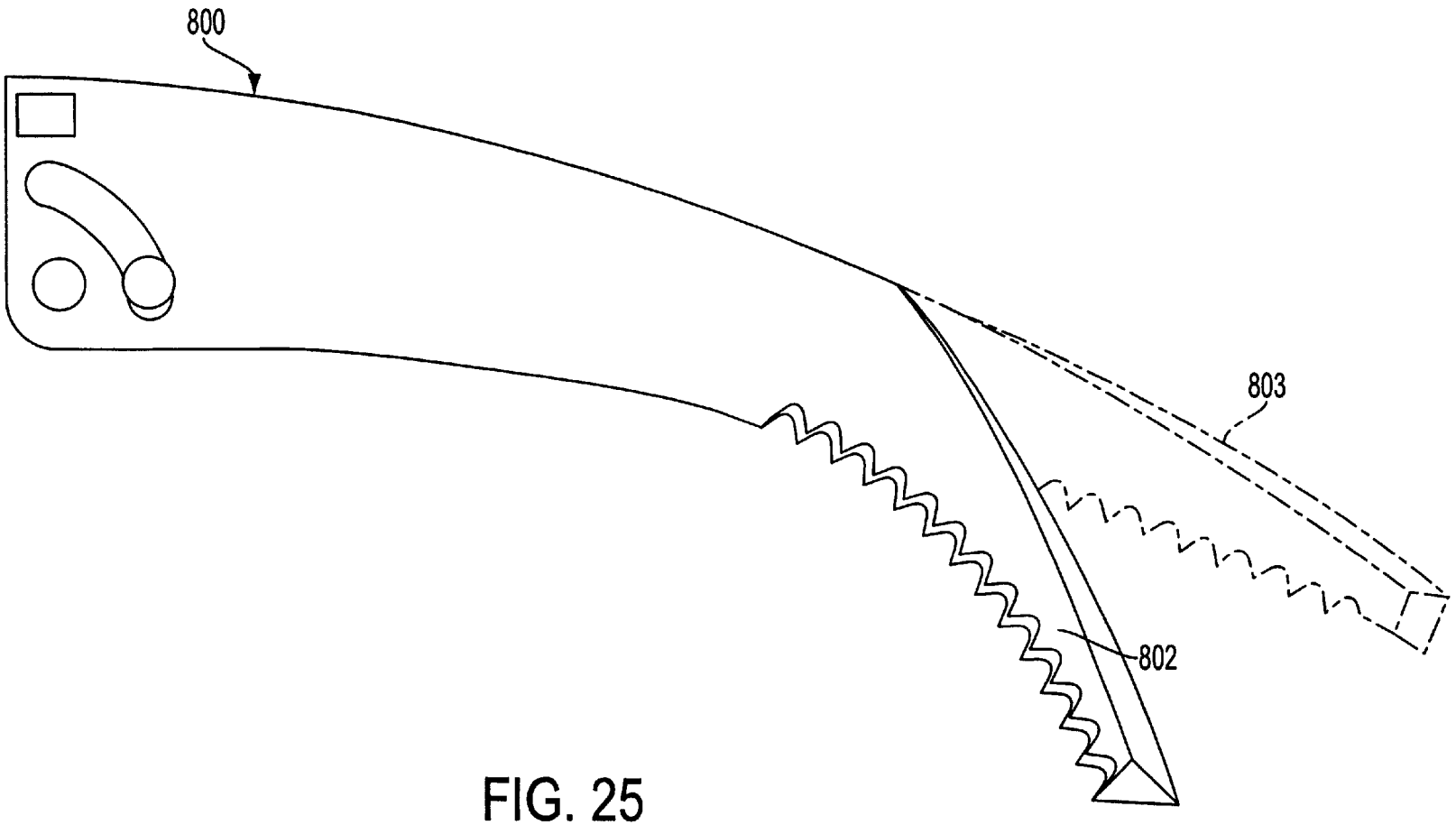

The blades which are used with this and/or any other embodiment, can be shaped in the manner depicted in FIG. 25. This blade 800 has a more acutely angled end or tip 802 so as to provide an even greater grip on hard surfaces such as concrete, steel, and the like type of materials which are apt to be encountered when scaling a building. The degree by which the curvature of this blade is increased as compared to the previously disclosed ones is evident from the phantom line outline 803.

Figure 26:
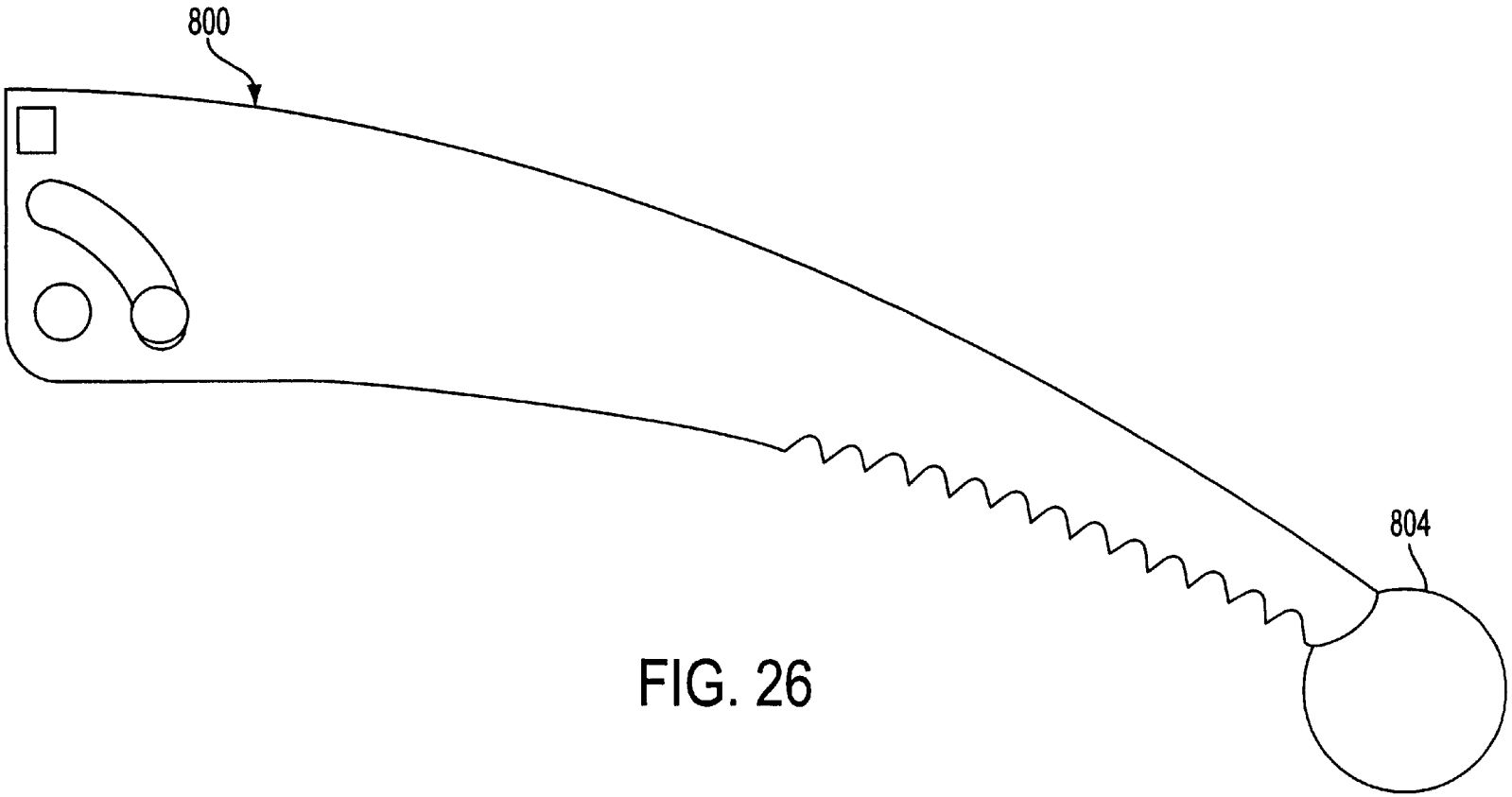
FIG. 26 is a side elevation of an arm which is similar to that shown in FIG. 7, but which is adapted for specialized use and is provided with a ball at the end to prevent the tip of the blade from digging into the ground.

FIG. 26 shows yet another blade design. In this arrangement the blade or arm 800 is provided with a steel or aluminum ball 804 at the end. This blade or arm 800 is designed for use on softer surfaces wherein the ball 804 is provided to prevent the tip of the blade from digging excessively into a soft surface such as soil or the like.

Figure 27:
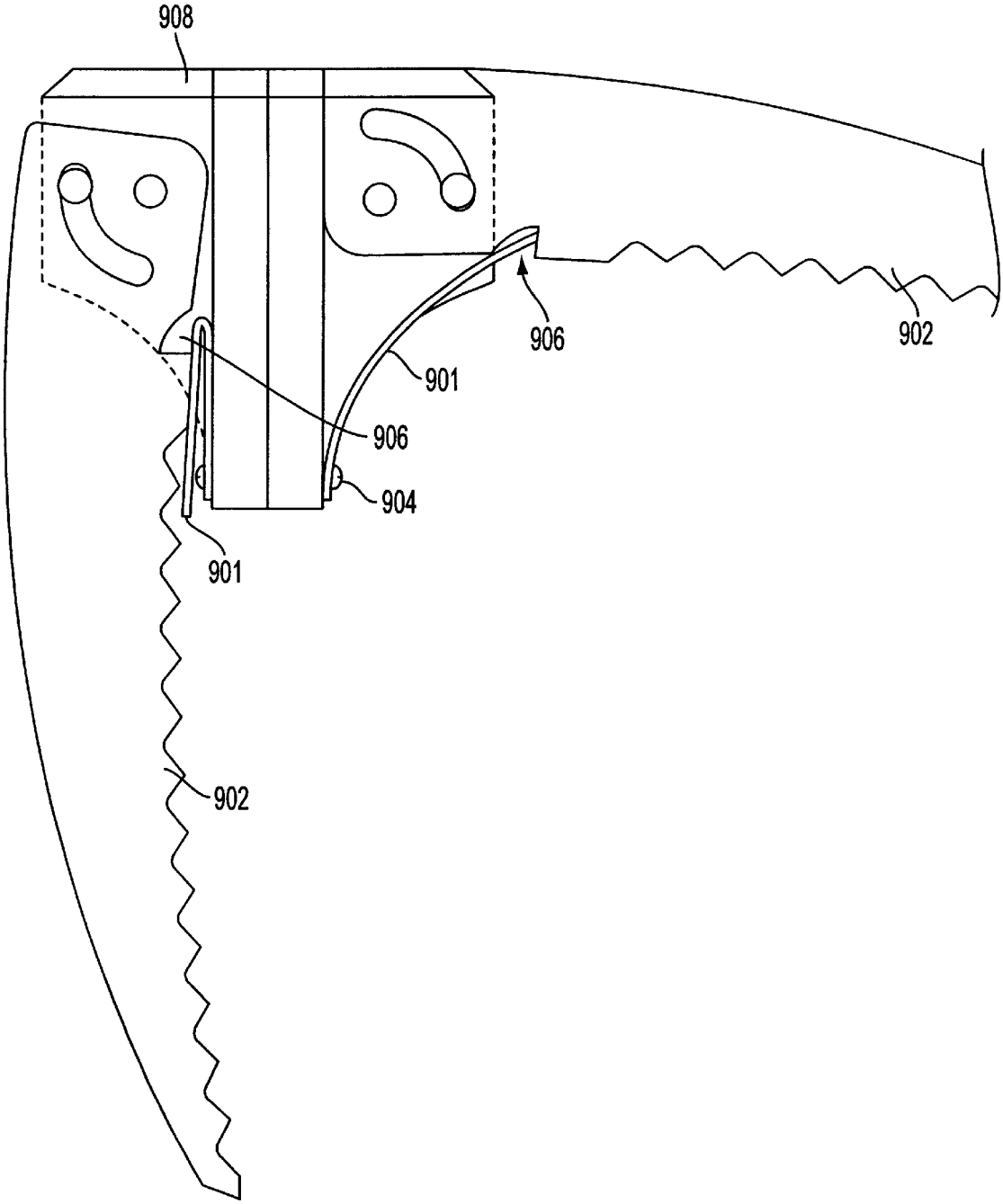
FIG. 27 is a side elevational view of a further embodiment of the invention which features flat springs which are used to selectively maintain the arms in an extended operation position.

FIG. 27 is a side elevational view of a further embodiment of the invention. In this arrangement, flat springs 901 are provided to permit the blades 902 to be biased to an open or operative position and selectively locked in the operative position. In this arrangement, the springs 901 each have their lower ends secured to the side of the head by way of screws or the like type fasteners 904. The springs 901 are sufficiently flexible to permit themselves to be folded over when the associated blade is folded down into a non-operative position such as depicted by the blade on the left handside of this figure. Means for retaining the blades 902 in the folded position are advantageous in this instance. Such an arrangement is similar to the retaining structures which are illustrated in FIGS. 21 and 22, merely by way of example. However, as will be apparent hereinafter, the retaining structures are not limited to such arrangements.

When the blades 902 are released and rendered free to rotate out to operative positions under the influence of the bias of springs 901, the free ends of the springs 901 are able to, upon the respective blade reaching its operative fully extended position, engage in shaped recesses 906 which are cut into the lower edges of the blades 902. As will be appreciated, in this state each blade 902 is prevented from returning to a folded or non-operative position both by the bias which is produced by a spring 901 and by the abutment of the free end of the spring against an engaging surface of the recess 906.

When it is desired to stow the device, all that is necessary is for the user to press the spring 901 with a thumb or finger and to fold each spring 901 over and induce the free end to move out of the recess 906 in which it is engaged. The blades 902 can then be folded down against the side of the head 908 thus inducing the situation shown on the left of the drawing.

Figure 28B:
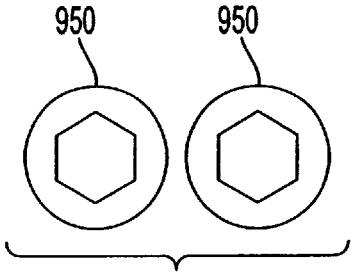
FIGS. 28A and 28B are respectively plan and elevational views showing the configuration of a "three-wing" head of the three bladed hook arrangement and socket head cap screws which are used to connect the arms or blades to the head.
Figure 28A:
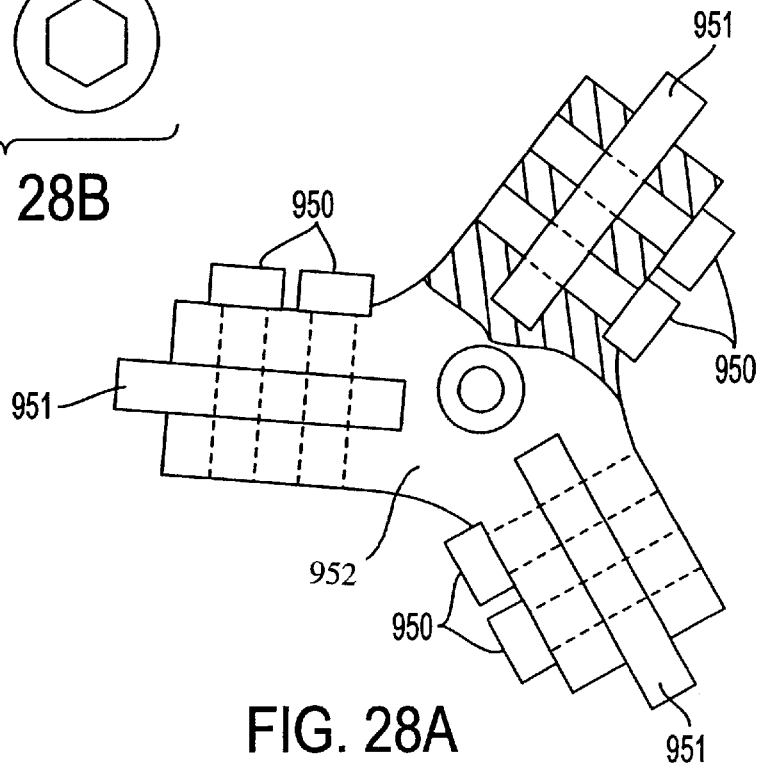
Figure 31:
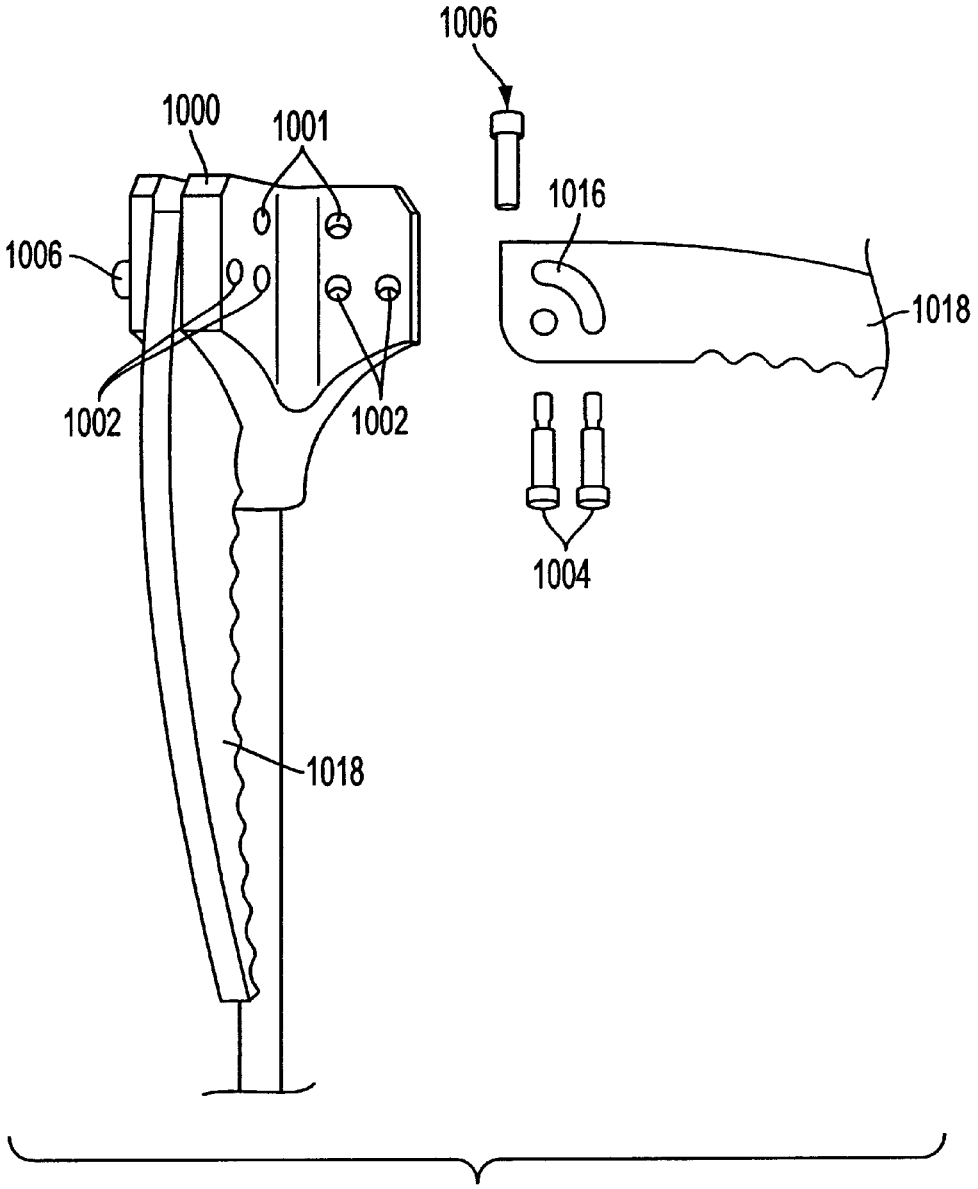
FIG. 31 is an exploded view showing a further embodiment of the invention wherein the arms or blades are selectively maintained in place by means of spring loaded bolts which are disposed through a third set of openings formed in wing portions of the head.
Figure 32:
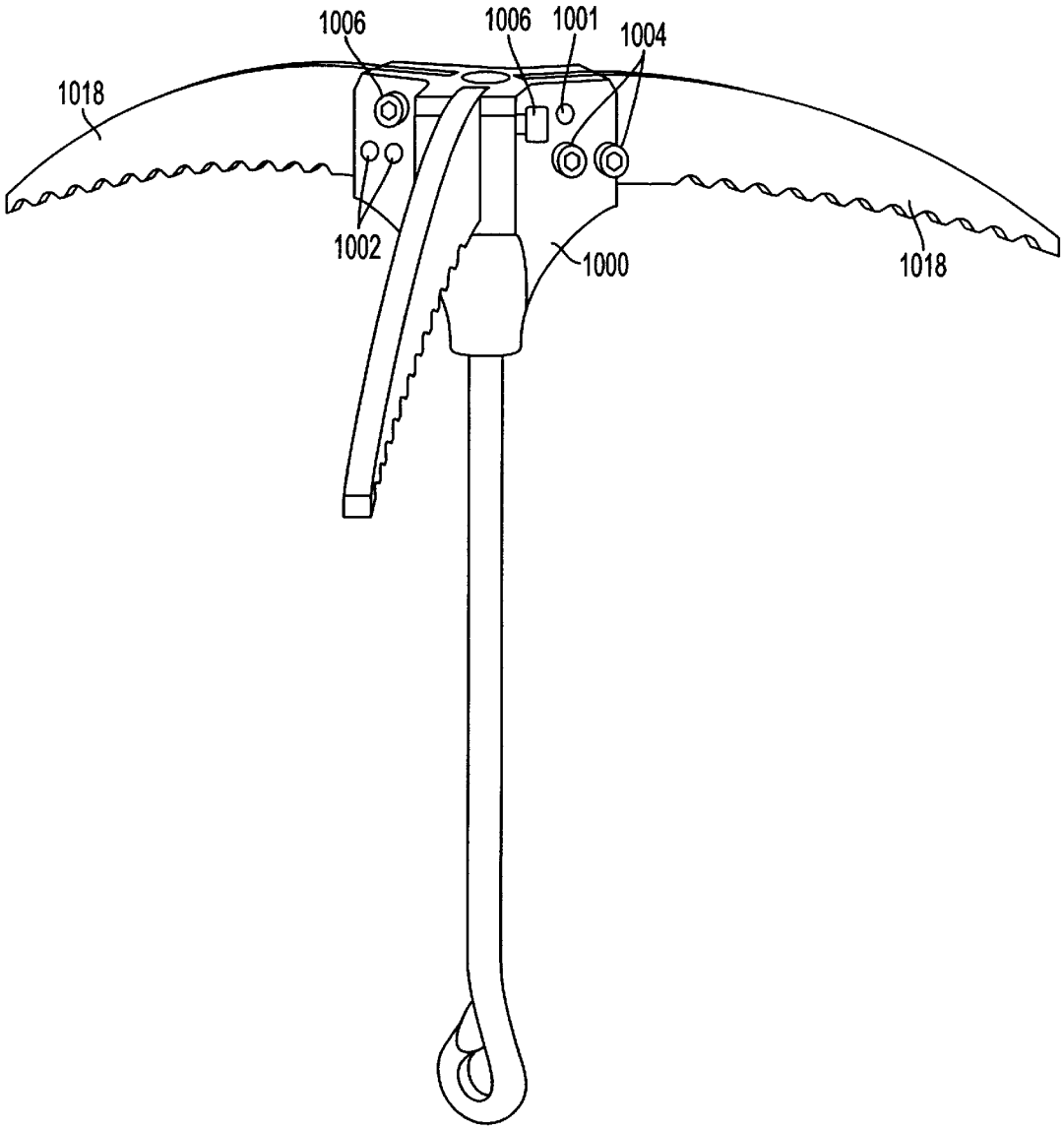
FIG. 32 is a perspective view showing the arrangement depicted in FIG. 31 in a fully assembled and ready to use configuration.

As mentioned previously, the invention can take the form of a three-blade arrangement. FIGS. 28A, 31 and 32 show arrangements of an embodiment which utilizes such a three-blade form. The arrangement which is shown in FIG. 28A is such as to use socket head cap screws 950 (see FIG. 28B) as the pins which connect the blades 951 to the head 952 of the device. As will be appreciated from the partially sectioned view of FIG. 28A, the three blade head arrangement is such as to provide sufficient space for easy access to the screws 950 which are used to pivotally support the blades 951 and thus facilitate easy interchange of blades should one become broken or if a different type of blade is required for a particular operation.

Figure 29:
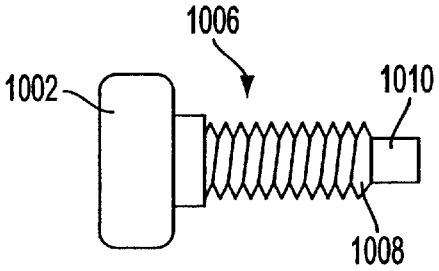
FIG. 29 is a side view of a spring loaded pin/bolt arrangement which can be used with the arrangement shown in FIGS. 31 and 32.
Figure 30:
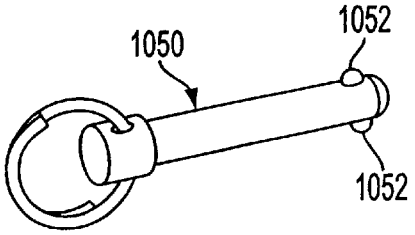
FIG. 30 is a perspective view of second type of spring loaded pin/bolt which can alternatively be used with the arrangement shown in FIGS. 31 and 32.

FIGS. 29 and 30 show examples of spring loaded bolts/pins which can be used in connection with the embodiments of the invention shown in FIGS. 31 and 32.

In the embodiments shown in FIGS. 31 and 32, the "three blade" head (as it will be referred to) 1000 is formed with a third bore 1001 which is located above those (1002) in which the support pins (e.g. the socket head cap screws) 1004 are disposed. Depending on the pin which is selected for use, these third bores 1001 can be either tapped or plain. A tapped bore however, permits the use of both of the arrangements shown in FIGS. 29 and 30.

More specifically, the arrangement shown in FIG. 29 is a hand retractable spring plunger 1006 which has a tapped body 1008 and spring loaded pin 1010 reciprocally received therein. The head 1000 shown in FIG. 32, which is usually knurled for a good grip, is connected with the pin 1010 so that it can 5 be manually retracted against a spring bias from a protruding position. These type of devices are commercially available and are marketed by various manufacturers.

As best seen in FIG. 32, the plungers 1006 are threaded into the third bores 1001 on the opposite side of the blade support structures as the cap screws 1004 (which are received in tapped bores 1002) to maximize the amount of space available for an operator to grasp a head 1000 and to retract the pin 1010 with the minimum of interference from the remaining components. The bores 1001 are located so as to correspond with the upper end portions of the arcuate slots 1016 which are formed in the blades 1018. This enables the pin 1010 to projected into the slot 1016 when the blade 1018 is pivoted to an operative position and to lock it in place.

Manual retraction of each of the pins 1010 from the arcuate slots 1016 permits the corresponding blade to be pivoted back to its stored or folded position. Release of the head 1000 enables the pin 1010 to again project. However, this time the pin 1010 can extend adjacent an inboard edge of the blade 1018 and thus block pivotal motion away from the stored state. Accordingly, to unfold the device, each blade 1018 must be released via retraction of a pin 1010, the blade 1018 pivoted toward an operative position and the pin 1010 released so as to protrude into the slot 1016 formed in that blade.

In addition to the sturdy and simple arrangement the above structure represents, the provision of the plungers 1006 actually provides each blade 1018 with a third point of support when they are deployed, which increases the strength of the head-blade interconnection. This of course is such as to improve the strength of the body-blade connection.

A combination of spring and plunger arrangement can envisaged. The spring, in this instance, can any one of those depicted in FIGS. 16, 21 or in 27, merely by way of example, That is to say, the operator only needs to retract a plunger and allow the spring arrangement to pivot the blade to an operative position. With three simple operations the device can be readied for use. When it is desired to stow the device, each plunger can be retracted and the blade manually pressed down against the spring force. When the plunger is released, it engages an edge of the blade and prevents it from being pivoted back out to its operative state. Thus, three simple operations can ready the device for stowage.

The pin/bolt arrangement 1050 which is shown in FIG. 30, is a double ball ring-grip self locking pin. The two balls 1052 at the end of the pin 1050 are spring biased and once inserted into a bore tend to remain in position until such time as sufficient tractive force is applied to the ring. These types of locking arrangement can be simply inserted and removed from the third bores 1001 as desired.

Although the present invention has been described with reference to only a limited number of embodiments, the various modifications and changes which can be made without departing from the scope of the invention, is limited only by the appended claims, and will, in light of the preceding disclosure, be self-evident to the person of skill in the art to which the present invention pertains. By way of example, even though the embodiments have been illustrated as having a total of three or four blades, the invention is not so limited and the device may have as many blades as is deemed appropriate. For example, the device may be equipped with 4 or 8 pairs of blades (viz., 8 or 16 blades) or can have an odd number of blades. Additionally, a mixture of different sized/shaped interchangeable blades may also be employed to maximize the gripping effect on different closely juxtaposed surfaces such as concrete and steel.

What is claimed is:

1. A grappling hook comprising:

(a) head member;

(b) first and second pins;

(c) an arm pivotally mounted on the first pin, said arm being formed with a curved slot in which the second pin slides; and (d) a shaft operatively connected with said head member.

2. A grappling hook as set forth in claim 1, wherein said head member is formed with a slot and wherein said arm has an end portion received in the slot.

3. A grappling hook as set forth in claim 1, wherein said head member has a manually operable locking device which allows the arm to be selectively locked in a predetermined position.

4. A grappling hook as set forth in claim 1, further comprising biasing means for biasing the arm to pivot from a position wherein it is essentially parallel with the shaft to a position wherein it is essentially perpendicular to the shaft.

5. A grappling hook as set forth in claim 1, wherein said shaft is flexible and includes a connector at a lower end for connection with a rope or strap.

6. A grappling hook as set forth in claim 1 wherein said shaft is rigid and is provided with a screw thread at an upper end thereof.

7. A grappling hook as set forth in claim 1, wherein the arm is provided with a hook member which is adapted to clip onto the mouth of a barrel of a device capable of launching the grappling hook toward a selected target.

8. A grappling hook as set forth in claim 1, further comprising an elastomeric sleeve which fits over a barrel of a device which launches the grappling hook toward a selected target, the sleeve having a recess which receives an end of the arm that is distal from the first and second pins and which retains the arm in a position wherein it is essentially parallel with the shaft until such time as the grappling hook is launched from the barrel.

9. A grappling hook as set forth in claim 1, wherein said arm is provided with a plurality of serrations along a lower edge portion thereof.

10. A grappling hook as set forth in claim 9, wherein said arm is provided with a first sharp cutting edge along an upper edge portion thereof.

11. A grappling hook as set forth in claim 10, further comprising a second sharp cutting edge formed at a free end edge of the arm, the first and second sharp cutting edges forming two sharp points which dig into surfaces engaged thereby.

12. A grappling hook as set forth in claim 10, further comprising a ball-like member at the end of the arm, the ball-like member being dimensioned to prevent deep penetration into soft surfaces such as soil.

13. A grappling hook as set forth in claim 1, wherein each of the first and second pins comprise bolts which are threadedly received in tapped bores formed in said head member and which are selectively removable to permit arms to be interchanged.

14. A grappling hook comprising:

(a) head member having a plurality of arm receiving slots;

(b) a plurality of arms respectively received in said plurality of slots, each of said arms having a round hole and a curved slot formed therein;

(c) a plurality of first and second pins which are each secured to said head, each of the first pins being disposed through a round hole formed in each of said arms, and each of the second pins being disposed through a curved slot formed in each of said arms, each of the curved slots being so dimensioned that when the arms assume a first folded position, each of the second pins are located at or proximate a first end of the respective curved slots, and when the arms are swung out from the first folded position to a second unfolded position, the second pins are located at or proximate a second end of the respective curved slots; and (d) a shaft connected with said head member, said shaft being one of rigid and flexible.

15. A grappling hook as set forth in claim 14, further comprising locking means for locking the arms in their respective second unfolded positions.

16. A grappling hook as set forth in claim 15, wherein said locking means includes a locking aperture formed in each of the arms, the locking apertures being adapted to receive locking features which form part of said locking means.

17. A grappling hook as set forth in claim 15, further comprising a plurality of manually operated spring plungers, the plungers being threadedly received in a corresponding plurality of bores which are formed in the head at locations whereat a reciprocal member can engage in an upper end of a curved slot when a corresponding arm is in an unfolded position.

18. A grappling hook as set forth in claim 15, further comprising a plurality of lock pins which can be inserted into a corresponding plurality of bores which are formed in the head at locations whereat a pin can be disposed therethrough so as to engage in an upper end of a curved slot when a corresponding arm is in an unfolded position.

19. A grappling hook as set forth in claim 18, wherein each of said lock pins has a spring loaded member which projects from the pin in a manner which prevents the pin from being withdrawn until such time as the a predetermined tractive force is applied thereto.

20. A grappling hook as set forth in claim 14, further comprising a spring arrangement for biasing each arm to pivot about a first pin to an unfolded position.

21. A grappling hook as set forth in claim 20, wherein said spring arrangement comprises a plurality of coiled torsion springs, each torsion spring being arranged to cooperate with an arm.

22. A grappling hook as set forth in claim 20, wherein said spring arrangement comprises a one piece flat spring with a plurality of arm portions, each arm portion engaging an arm.

23. A grappling hook as set forth in claim 20, wherein said spring arrangement comprises a plurality of flat springs, each spring being rigidly connected at a lower end to a portion of the head member and arranged so that a free end is engageable in notch-like recesses formed in a lower edge portion of each arm when the arm is in the unfolded position.

24. A grappling hook as set forth in claim 14, wherein each of the first and second pins comprise bolts which are threadedly received in tapped bores formed in said head member and which are selectively removable to permit arms to be interchanged.

25. A grappling hook as set forth in claim 14, wherein said locking means comprises a plurality of spring loaded plunger arrangements which are each disposed in a plurality of support bores formed in the head, each of the plungers having a spring loaded pin which can be selectively withdrawn from a projecting state, each of the support bores being located so that a pin of each the respective plunger arrangement is received in an upper end of a curved slot when the corresponding blade is in an unfolded position and the pin is in a projected state.

26. A grappling hook as set forth in claim 14, wherein said locking means comprises a plurality of locking pins which are each disposed in a plurality of support bores formed in the head, each of the support bores being located so that a locking pin, which is disposed therein with a corresponding blade in an unfolded position, will pass through the upper end of the curved slot in the blade.

27. A grappling hook as set forth in claim 26, wherein the locking pins are arranged so that they can be selectively inserted and removed, and are further provided with spring loaded projections which facilitate retention in the support bore once inserted.

* * * * *